United States Patent [19]

Traeger et al.

[11] Patent Number: 4,619,209

[45] Date of Patent: Oct. 28, 1986

[54] FURNACE CONSTRUCTION

[76] Inventors: Joseph P. Traeger, 250 Oak St.; Randolph J. Traeger, 530 Alder St.; Mark A. Traeger, 540 Leo St., all of Mt. Angel, Oreg. 97362

[21] Appl. No.: 763,520

[22] Filed: Aug. 8, 1985

[51] Int. Cl.[4] ..... F23K 3/14; F23K 3/16

[52] U.S. Cl. ..... 110/110; 110/104 R

[58] Field of Search ..... 110/110, 104 R, 101 R, 110/108

[56] References Cited

U.S. PATENT DOCUMENTS

| | | | |
|---|---|---|---|
| 1,174,088 | 3/1916 | Mulock . | |
| 1,945,850 | 2/1934 | Filmer . | |
| 2,343,707 | 3/1944 | Roland | 110/108 X |
| 3,178,165 | 4/1965 | Zimmermann . | |
| 4,270,469 | 6/1981 | Gall . | |
| 4,323,017 | 4/1982 | Harris . | |
| 4,441,434 | 4/1984 | Howard . | |
| 4,450,776 | 5/1984 | Stevenson . | |

*Primary Examiner*—Edward G. Favors

*Attorney, Agent, or Firm*—Kolisch, Hartwell & Dickinson

[57] ABSTRACT

A furnace which includes a furnace chamber and a fire pot within the chamber for burning solid fuel fed into the fire pot. The fuel is introduced to the fire pot by traveling through a feed tube which extends into the furnace chamber. An air flow is produced for supporting combustion which flows from a chamber defined about the fire pot into the fire pot and also flows through the feed tube effectively to prevent smoke back flow. A metering wheel supplies the solid fuel which is burned from a hopper and this metering wheel, together with an auger which moves fuel through the feed tube, are organized and arranged in such a manner as to eliminate hazardous back burning of fuel.

8 Claims, 2 Drawing Figures

FURNACE CONSTRUCTION

BACKGROUND AND SUMMARY OF THE INVENTION

This invention relates to a furnace construction, and more particularly to a furnace which may be operated over an extended period of time without supervision to produce a controlled heat output from particulate solid fuel, exemplified by wood waste pellets, wood chips, cut poplar segments, etc. The furnace contemplated efficiently burns solid fuel of this description in a manner which produces controlled heat output through intermittent feeding of fuel in a non-hazardous manner, and without backup smoking occurring through systems supplying the furnace with fuel and air.

A general object of this invention, therefore, is to provide an improved, solid-fuel burning furnace effective to give a controlled, even heat output.

Another object is to provide such a furnace which is non-hazardous, in that features are incorporated in the furnace preventing burn-back of fuel in the supply system which supplies fuel to the furnace.

Yet a further object is to provide a new and improved furnace which includes means for metering a supply of fuel fed to the furnace.

A still further object is to provide a furnace incorporating a unique air flow system for supplying air to support combustion, and which is also effective to inhibit back flow of smoke through the fuel supply system.

These and various objects and advantages are attained by the invention, which is more fully described below, in conjunction with the accompanying drawings wherein:

FIG. 1 is a side elevation, in somewhat simplified form, of a furnace as contemplated herein; and FIG. 2 is a dross-sectional view, taken generally along the line 2—2 in FIG. 1.

DESCRIPTION OF THE DRAWINGS

Referring now to the drawings, the apparatus illustrated comprises a generally rectangular shaped housing 10, which is divided intermediate opposite sides by an upstanding inner wall 12. That portion of the housing which is to the left of this wall in the drawings is provided around its interior with suitable insulation to provide an insulated fire wall surrounding a furnace chamber shown at 14. That portion of the housing which is to the right of the inner wall, shown at 16, is utilized in the housing of a bin for holding fuel, a feed system for feeding the fuel to the furnace chamber, a blower system, and other components to be described for operating the furnace, and is referred to herein as an equipment chamber.

Located within furnace chamber 14 is a jacketed fire pot assembly 18. Such includes an internal fire pot 20 which may be substantially cylindrical in shape, has an open top and is closed off at its base by a floor 22. Distributed about the cylindrical side of the fire pot are a series of bores or holes 24 which accommodate the passage of combustion-supporting air from outside the pot into the interior of the pot.

Figure 2:
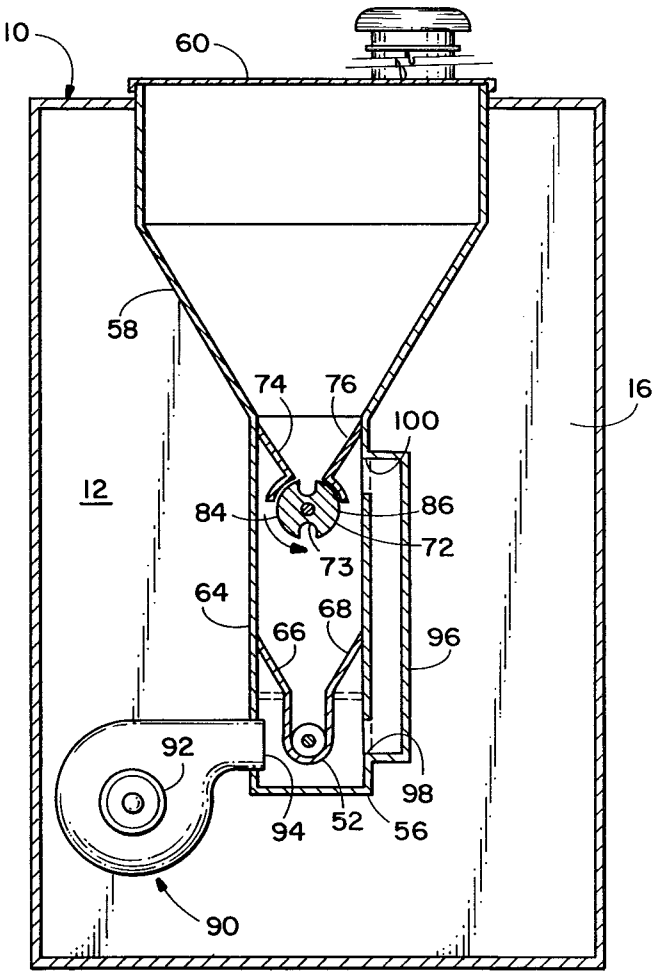

The fire pot is encompassed by housing or enclosure structure 26, which for ease of fabrication purposes, may be of generally a rectangular shape, and includes a base 28, opposed sides, such as sides 29, 30, and a top 32 spanning the space between the upper margins of the sides and the cylindrical side of the fire pot where such projects upwardly beyond top 32. Enclosure structure 26 defines a chamber 34 surrounding most of the fire pot adapted to receive air introduced thereinto and to channel such air whereby such thence flows through bores 24 into the fire pot.

The top of the furnace chamber is vented by a suitable vent duct 36 through which products of combustion leave the furnace chamber.

If desired, a hood such as hood 40 may be mounted in spaced relation above the top of fire pot 20. Solid material such as ash entrained in hot gases flowing from the top of the pot tend to impinge on this hood thence to drop to the floor of the furnace chamber instead of being carried outwardly from the chamber through duct 36.

Figure 1:
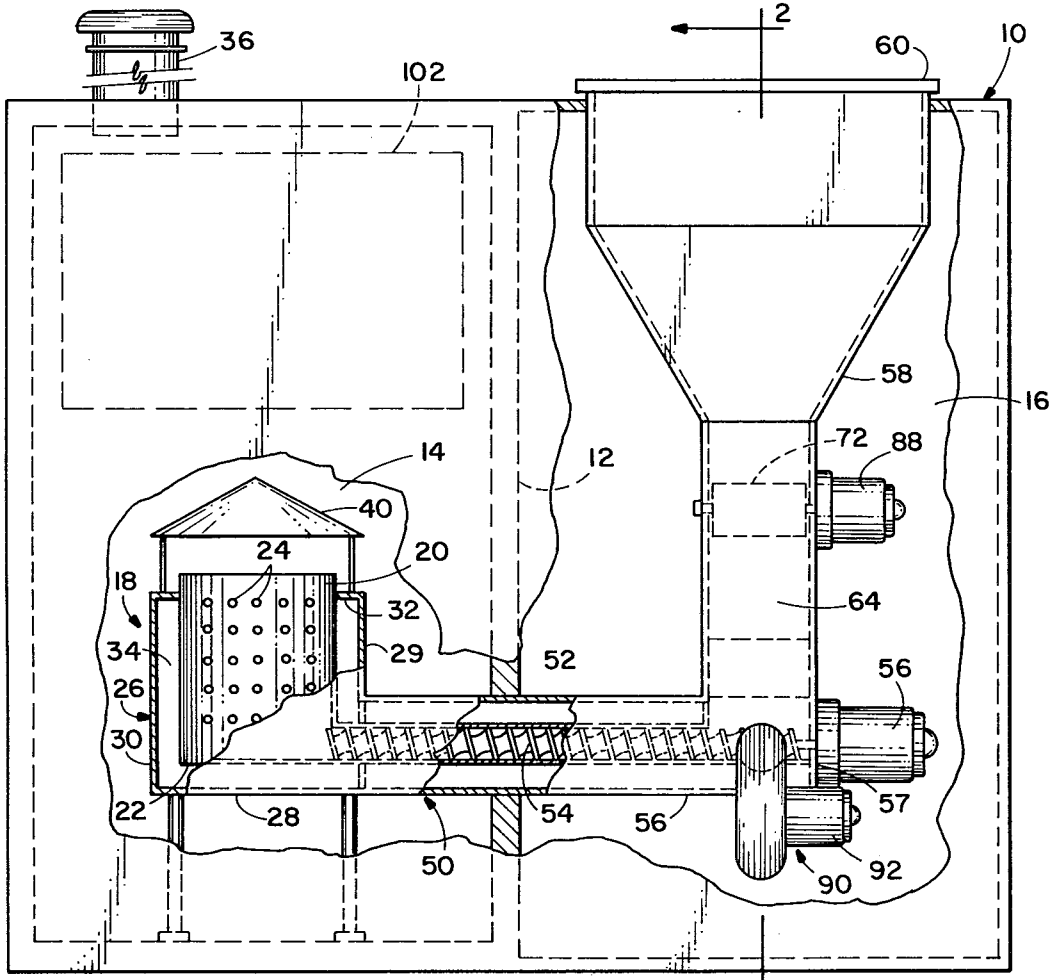

Access to the furnace chamber, for cleaning purposes, etc., is provided by a suitable door, not shown in FIG. 1 as being part of the structure broken away in FIG. 1.

Connecting with the jacketed fire pot assembly adjacent its base is a feed tube and air duct assembly 50 which extends through wall 12 to an end located within an adjacent the base of the equipment chamber.

Assembly 50 includes a feed tube 52 extending along the interior of the assembly with an outfeed end joined to the side of the fire pot. The side of the fire pot has an opening which joins with the interior of feed tube 52 and in this way the feed tube provides a passage for the supply of fuel to the base of the fire pot. Fuel, such as pelletized fuel, is moved down the feed tube through operation of an auger 54, which extends longitudinally along the feed tube interior. The auger is powered by a motor, such as electric motor 56, which has its output shaft connected to the auger for driving purposes.

A supply of fuel for the furnace is stored within a hopper 58 located above assembly 50. A removable cover 60 closes the top of the hopper. With the cover removed, access is provided to the hopper for the purpose of replenishing the fuel supply.

Encompassing feed tube 52 is an elongate air duct 56 forming part of assembly 50. As shown, such may be of a substantially rectangular cross section. With the inner sides of the duct spaced from the outside of the feed tube, an air flow channel is provided between the interior of the duct and the exterior of the tube for the flow of air. The duct joins with side 29 of housing structure 26, and this side is opened up whereby the interior of the duct communicates with chamber 34 surrounding the fire pot.

Closing off the extreme end of the feed tube and duct assembly, where such is located in equipment chamber, is an end wall 57.

Connecting the base of hopper 58 with the top of duct 56 is an upstanding feed duct 64.

Within duct 64, adjacent its base, are a pair of inclined fuel guide plates 66, 68, leading to an opening in the top of feed tube 52, which exposes the infeed end of the auger extending below the opening. The guide plates serve to funnel any fuel falling downwardly in the feed duct, whereby such is directed to the interior of the feed tube, thence to be carried down the tube through operation of the auger.

The apparatus contemplated includes a metering system whereby metered amounts of fuel are fed on demand from the hopper to be delivered into the interior of the feed duct. Specifically, adjacent the top of the feed duct and spaced above the feed tube a distance which may be six inches or more is a cupped metering wheel 72. Such may take the form of an elongate cylinder with one or more recesses indented inwardly on the cylinder and extending along the length of the cylinder, as exemplified by recesses 73. Fuel guide plates 74, 76 extend from the base of the hopper in duct 64 to define a mouth which is spanned by the metering wheel.

The recesses earlier described are separated on the periphery of the wheel by curved expanses 84, 86. With the wheel as shown in FIG. 2, a recess is directly below the mouth defined by guide plate 74, 76, and fuel held in the hopper falls downwardly by gravity to fill the recess. With the wheel rotated from the position shown, a curved expanse on the periphery of the wheel moves to a position closing off the mouth defined by guide plate 74, 76. Further rotation of the wheel is effective to place the recess facing downwardly whereby the contents of the recess is fully dumped with the material falling down duct 64 and thence entering the feed tube.

The metering wheel is rotated under power with energizing of electric drive motor 88.

Also provided in the equipment chamber is a blower unit shown at 90. The blower unit is driven by blower motor 92. The discharge end of the blower unit connects at 94 with the interior of duct 56.

As can be seen with reference to FIG. 2, secured along a side of feed duct 64 is what is referred to as a circulation duct 96. Openings shown at 98 and 100 connect the base of the circulation duct with air duct 56 and the top of the circulation duct with an upper portion of feed duct 64. With the provision of this circulation duct, a portion of the air forced into air duct 56 flows through opening 100 and upwardly in the circulation duct to be expelled in the feed duct adjacent the metering wheel. This air then travels downwardly through the feed duct thence to travel through the feed tube into the interior of the fire pot. This path for the flow of air is in addition to the path provided by the air duct, such air flowing down the air duct to be expelled into the chamber defined about the fire pot by housing structure 26.

Shown in outline at 102, and located within the furnace chamber above the jacketed fire pot assembly, is a heat exchange system. With the furnace used to provide hot air for space heating purposes, this exchanger system may be an air-to-air heat exchanger device with circulated air heated by the exchanger system suitably channeled to areas where space heating is desired. Alternatively, the exchanger system may comprise a coil network through which water is circulated, with water heated by the system being circulated through heat exchanger means where space heating is desired. Whatever the exchanger system utilized, an efficient use of the heat generated by the burning fuel may be realized.

During operation of the furnace, a combustion-supporting air flow is produced through air duct 56 which travels into the fire pot 20 through holes 24. It is important that a concurrent air flow be produced through feed tube 52 to combat what otherwise might be a tendency for air to back flow from the fire pot and through the feed tube into the equipment chamber.

During operation of a typical furnace, ordinarily the metering wheel runs at a relatively slow speed, with one revolution per minute being fairly typical. The auger within the feed tube, on the other hand, is run at a somewhat faster speed with a speed of ten revolutions per minute being typical. As a consequence, and because the carrying capacity of the auger between adjacent flights substantially exceeds the carrying capacity of one of the indents in the metering wheel, the space between the bottom of the metering wheel and the top of the auger always is maintained clear of material, and the auger is always operated while only partially loaded with material.

The furnace described may be, and usually is, operated intermittently. During start-up of a cycle of operation the motors running the blower, auger, and metering wheel are all energized to produce air flow through air duct 56, the feed tube 50, movement of material by the rotating auger, and metered flow of material to the infeed end of the auger. At the end of a cycle of operation, these motors may all be stopped together. Alternatively, the motor driving the metering wheel may be stopped first. The motor driving the auger may be left running for a short period of time, to clear the feed tube completely of material. The blower motor may be stopped at a still later time, to produce air-flow-promoted burning of material in the fire pot for a short period of time after the feed of fuel has stopped.

The furnace may be controlled by a thermostat or other heat sensitive means. Absent demand, an operating cycle may be initiated, for example every half hour, and maintained, for example, for a period of three minutes, this operating cycle being sufficient to maintain a fire burning within the fire pot with the usual pelleted or cut solid fuel which the furnace utilizes.

While a particular embodiment of the invention has been described, it should be apparent that variations and modifications are possible without departing from the invention.

It is claimed and desired to secure by letters patent:

1. In a furnace, a pot with an open top for holding fuel during the burning process, an elongate tube connecting at the outfeed end thereof with the interior of the pot and extending laterally therefrom, and an elongate rotatable auger extending within the tube for moving fuel along the length of the tube and thence into the pot, perforate means formed in the side of the pot, and air-flow-producing means including power-driven blower means, structure connecting with said blower means producing air flow by the blower means from outside the perforate means and through the perforate means to the pot interior for supporting combustion, and structure connecting with said blower means producing air flow by the blower means through said tube and out the outfeed end thereof to further support combustion and to inhibit reverse air flow through the tube.

2. The furnace of claim 1, wherein the tube has an infeed end and an entrance facing upwardly at its infeed end, said entrance providing for gravity flow of fuel from the entrance onto the auger where such extends below the entrance, and which further includes a pocketed rotatable metering wheel for feeding metered amounts of particulate solid fuel spaced above said entrance in a relationship whereby fuel free-falls from the metering wheel into said entrance, and powered means for rotating the auger and metering the wheel at relative speeds whereby the carrying capacity of the auger exceeds the carrying capacity of the metering wheel.

3. The furnace of claim 2, wherein the structure connecting with said blower means producing air flow through said tube has a construction wherein air is directed in a flow path extending downwardly into said entrance with air flow then occurring through said tube and out the outfeed end thereof.

4. The furnace of claim 2 wherein said powered means comprises auger motor means for rotating said auger and metering wheel motor means for rotating said metering wheel.

5. The furnace of claim 1, wherein said tube has an entrance adjacent an infeed end thereof, and wherein said structure connecting with said blower means for producing air flow through the perforate means comprises an encompassing enclosure for said pot defining a chamber surrounding said pot communicating with said perforate means and a duct connecting the discharge f said blower means and said chamber, and wherein the structure connecting with said blower means for producing air flow through said tube comprises a duct connecting the discharge of said blower means and said entrance of said tube.

6. A furnace comprising a pot with an open top for holding fuel during the burning process, an elongate tube connecting at the outfeed end thereof with the interior of the pot and extending laterally therefrom and an elongate rotatable auger within the tube for moving fuel along the length of the tube into the pot, said tube having an infeed end and an entrance facing upwardly at its infeed end which provides for gravity flow of fuel from the entrance onto the auger extending below the entrance, a rotatable metering wheel for feeding metered amounts of particulate solid fuel spaced above said entrance in a relationship whereby fuel free-falls from the metering wheel into said entrance, and powered means for rotating the auger and metering wheel at relative speeds whereby the carrying capacity of the auger exceeds the carrying capacity of the metering wheel.

7. The furnace of claim 6, which further comprises air-flow-producing means including power-driven blower means producing an air flow in a path which extends into said entrance and thence along the length of the tube to the outfeed end of the tube, such air supporting combustion within said pot and further inhibiting reverse flow of air through the tube.

8. The furnace of claim 7, wherein and air-flow-producing means includes an encompassing enclosure for said pot defining a chamber surrounding the pot communicating with perforate means in the pot, a duct connecting the discharge of said blower means and said chamber, and a duct connecting the discharge of said blower means with the entrance of said tube.

* * * * *